US010376107B1

(12) United States Patent
Reneau

(10) Patent No.: US 10,376,107 B1
(45) Date of Patent: Aug. 13, 2019

(54) FOOT-SCRUBBING RECEPTACLE FOR A SHOWER

(71) Applicant: Max Reneau, Emporia, KS (US)

(72) Inventor: Max Reneau, Emporia, KS (US)

( * ) Notice: Subject to any disclaimer, the term of this patent is extended or adjusted under 35 U.S.C. 154(b) by 267 days.

(21) Appl. No.: 15/496,099

(22) Filed: Apr. 25, 2017

(51) Int. Cl.
*A47K 7/02* (2006.01)
*A47K 7/03* (2006.01)

(52) U.S. Cl.
CPC ..... *A47K 7/026* (2013.01); *A47K 7/03* (2013.01)

(58) Field of Classification Search
CPC . A47K 7/026; A47K 7/02; A47K 7/03; A47K 3/022; A47K 3/062; A47K 4/024; A47L 23/22; A61H 35/006
USPC ..... 15/104.92
See application file for complete search history.

(56) References Cited

U.S. PATENT DOCUMENTS 3,548,439 A * 12/1970 Berst ..... A47K 7/026 15/104.92
3,973,286 A * 8/1976 Logan ..... A47K 3/022 15/88.3
4,489,448 A 12/1984 Cairo
D287,075 S 12/1986 Colin
5,341,528 A 8/1994 Sultzbaugh
D351,647 S 10/1994 Sultzbaugh
5,579,545 A 12/1996 Beard
5,640,723 A 6/1997 Stanek
5,724,695 A * 3/1998 Galizia ..... A46B 5/04 15/104.92
5,920,926 A 7/1999 Torres
6,115,857 A 9/2000 Bidegain
6,223,379 B1 5/2001 Martin
6,684,444 B2 * 2/2004 Wheeler ..... A47K 7/026 15/110
7,886,376 B2 2/2011 Ray

* cited by examiner

*Primary Examiner* — Laura C Guidotti
(74) *Attorney, Agent, or Firm* — Kyle A. Fletcher, Esq.

(57) ABSTRACT

The foot-scrubbing receptacle for a shower is adapted for use with the foot of a bather. The foot-scrubbing receptacle for a shower is configured for use with a shower. The foot-scrubbing receptacle for a shower is a cleaning device. The foot-scrubbing receptacle for a shower cleanses a foot of a bather while simultaneously allowing the bather to stand erect. The foot-scrubbing receptacle for a shower comprises a shell and a cabinet. The cabinet inserts into the shell in a removable manner. To cleanse the foot, the forefoot is inserted into an open end of the foot-scrubbing receptacle for a shower where the foot is rubbed against the cleansing surface. A pedal operated soap dispenser is installed in the foot-scrubbing receptacle for a shower such that the soap may be dispensed on the foot for cleansing purposes.

18 Claims, 5 Drawing Sheets

FOOT-SCRUBBING RECEPTACLE FOR A SHOWER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including sanitary equipment not otherwise provided for, more specifically, a body washing implement for cleaning the feet and toes.

SUMMARY OF INVENTION

The foot-scrubbing receptacle for a shower is adapted for use with the foot of a bather. The foot-scrubbing receptacle for a shower is configured for use with a shower. The foot-scrubbing receptacle for a shower is a cleaning device. The foot-scrubbing receptacle for a shower cleanses a foot of a bather while simultaneously allowing the bather to stand erect. The foot-scrubbing receptacle for a shower comprises a shell and a cabinet. The cabinet inserts into the shell in a removable manner. To cleanse the foot, the forefoot is inserted into an open end of the foot-scrubbing receptacle for a shower where the foot is rubbed against the cleansing surface. A pedal operated soap dispenser is installed in the foot-scrubbing receptacle for a shower such that the soap may be dispensed on the foot for cleansing purposes.

These together with additional objects, features and advantages of the foot-scrubbing receptacle for a shower will be readily apparent to those of ordinary skill in the art upon reading the following detailed description of the presently preferred, but nonetheless illustrative, embodiments when taken in conjunction with the accompanying drawings.

In this respect, before explaining the current embodiments of the foot-scrubbing receptacle for a shower in detail, it is to be understood that the foot-scrubbing receptacle for a shower is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the foot-scrubbing receptacle for a shower.

It is therefore important that the claims be regarded as including such equivalent construction insofar as they do not depart from the spirit and scope of the foot-scrubbing receptacle for a shower. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 2:
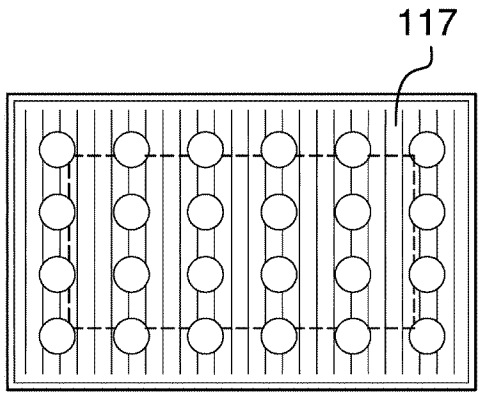
FIG. 2 is a bottom view of an embodiment of the disclosure.
Figure 1:
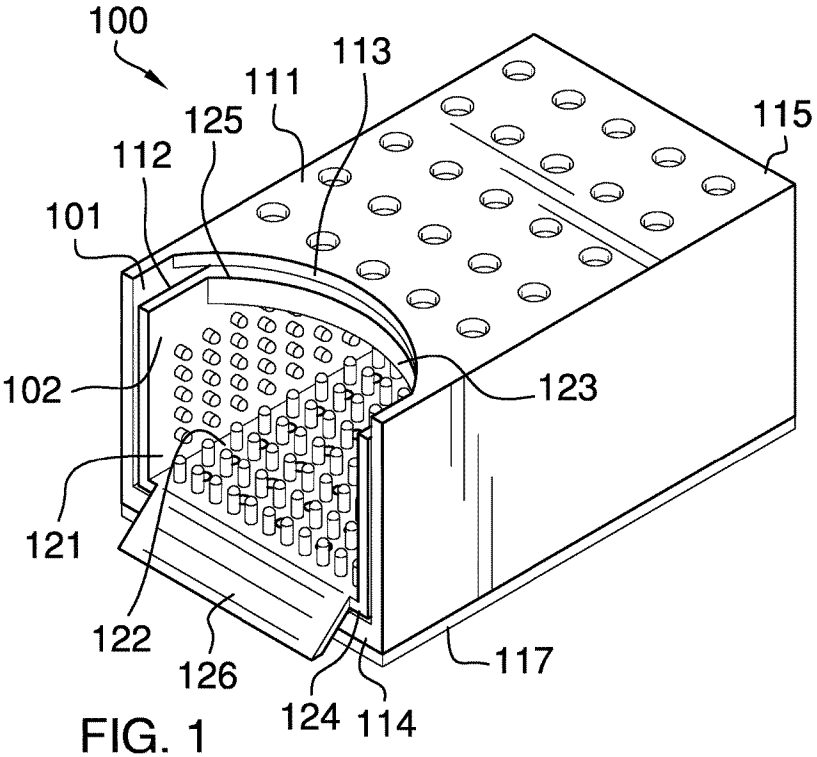
FIG. 1 is a perspective view of an embodiment of the disclosure.
Figure 3:
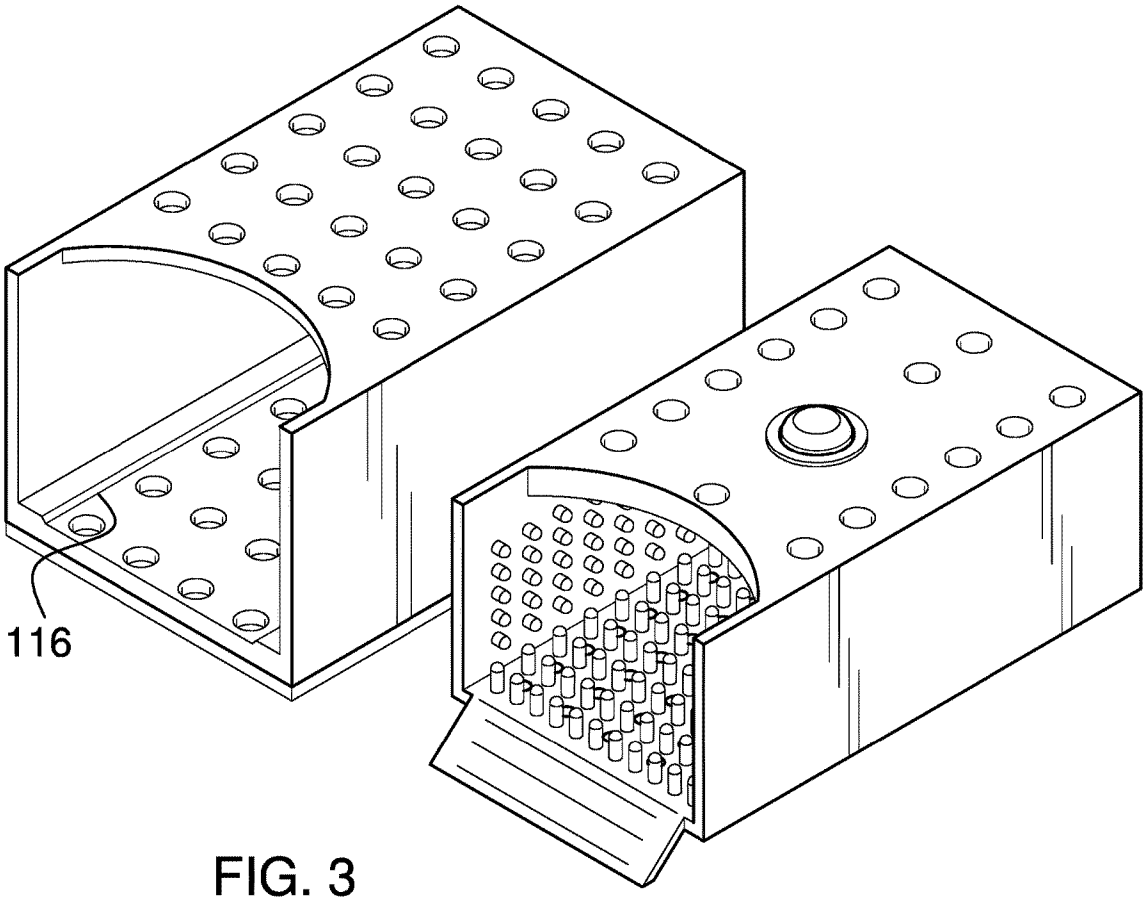
FIG. 3 is an exploded view of an embodiment of the disclosure.
Figure 5:
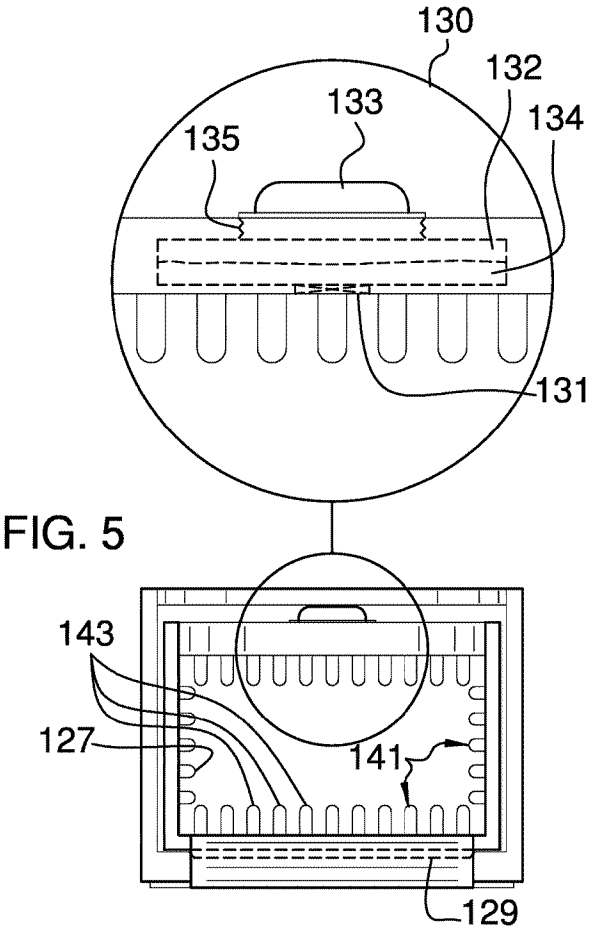
FIG. 5 is a front view of an embodiment of the disclosure.
Figure 4:
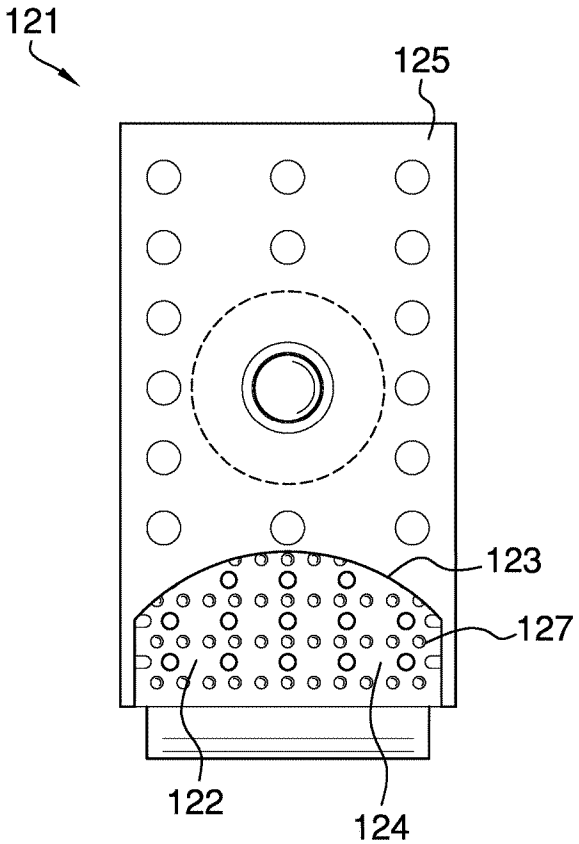
FIG. 4 is an exploded top view of an embodiment of the disclosure.
Figure 6:
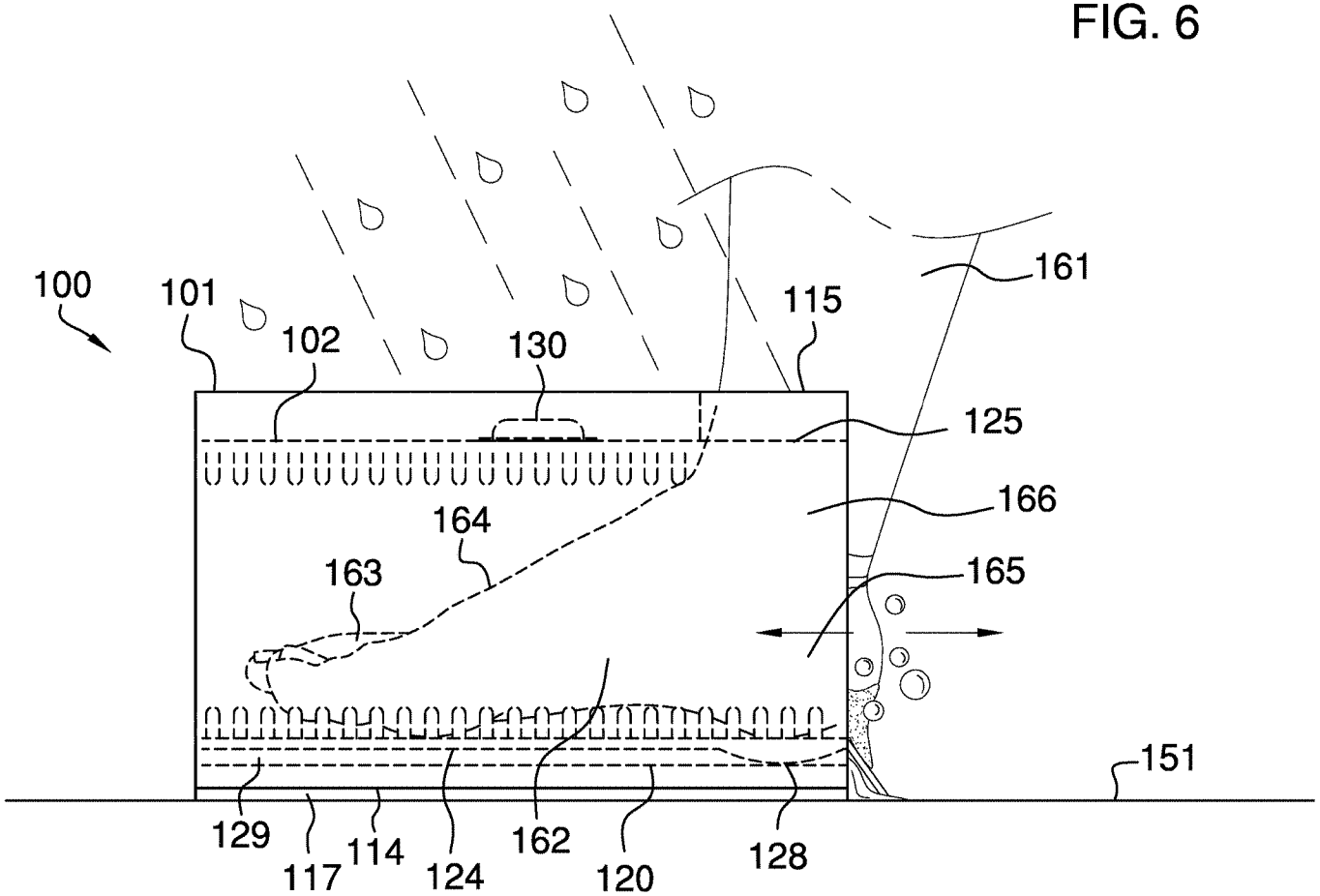
FIG. 6 is an in use view of an embodiment of the disclosure.
Figure 7:
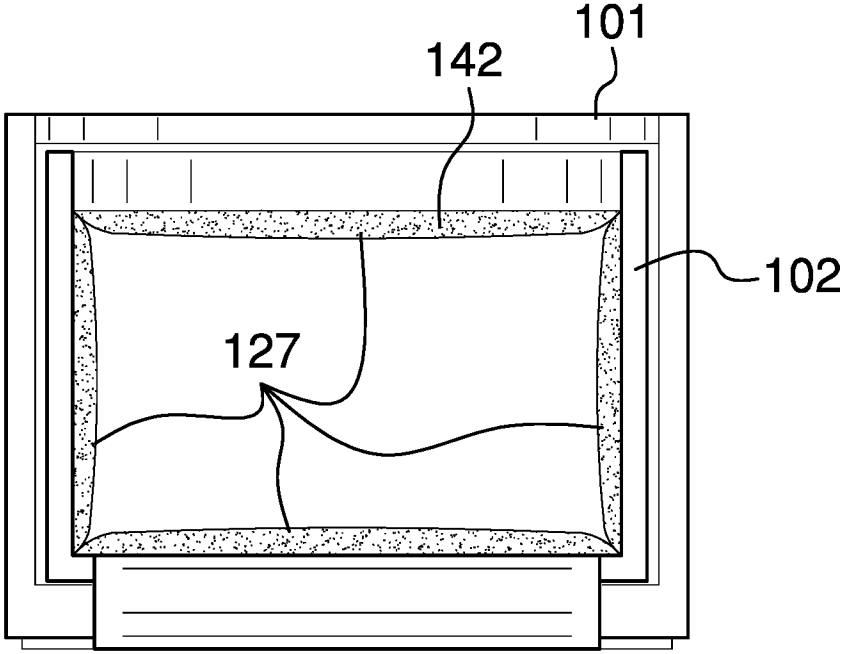
FIG. 7 is a front view of an alternative embodiment of the disclosure.

Detailed reference will now be made to one or more potential embodiments of the disclosure, which are illustrated in FIGS. 1 through 7.

The foot-scrubbing receptacle for a shower 100 (hereinafter invention) is adapted for use with the foot 162 of a bather 161. The bather 161 refers to the person who is using the invention 100. The bather 161 is further defined with a foot 162. The foot 162 refers to the portion of a leg of the bather 161 that is below the ankle 166 and that is inserted into the invention 100. The foot 162 is further defined with a forefoot 163, a midfoot 164, and a hind foot 165. The invention 100 is configured for use with a shower. The invention 100 is a cleaning device. The invention 100 cleanses the foot 162 of the bather 161 while simultaneously allowing the bather 161 to stand erect. The invention 100 comprises a shell 101 and a cabinet 102. The cabinet 102 inserts into the shell 101 in a removable manner. To cleanse the foot 162, the forefoot 163 is inserted into an open end of the invention 100 where the foot 162 is rubbed against a cleansing surface 127 within the cabinet 102. A pedal operated soap dispenser 130 is installed in the invention 100 such that the soap 134 may be dispensed on the foot 162 for cleansing purposes.

The shell 101 is a first hollow structure. The shell 101 forms the exterior surfaces of the invention 100. The shell 101 is placed on a supporting surface 151. The supporting surface 151 is the surface of a shower upon which the bather 161 stands. The shell 101 is positioned such that the foot 162 of the bather 161 can be inserted into the invention 100. The shell 101 comprises a first structure 111 and a non-skid footing 117.

The first structure 111 comprises a first opening 112, a first arch 113, a first inferior face 114, a first superior face 115, and an alignment track 116. The first inferior face 114 is further defined with an interior surface and an exterior surface. The first superior face 115 is further defined with an interior surface and an exterior surface.

The non-skid footing 117 is a non-skid material that is attached to the exterior surface of the first inferior face 114. The non-skid footing 117 keeps the invention 100 from moving during use.

The first structure 111 is a first hollow rectangular block structure that is used to house the cabinet 102. The first opening 112 of the first structure 111 is an open face into which the cabinet 102 and the foot 162 are inserted. The first inferior face 114 is the face of the first structure 111 that is placed upon the supporting surface 151. The first inferior face 114 is formed as a foraminous surface that allows water to flow through the invention 100. The first superior face 115 is the face of the first structure 111 that is distal from the first inferior face 114. The first superior face 115 is formed as a foraminous surface that allows water to flow through the invention 100.

The first arch 113 is a curved boundary that forms a negative space in the first superior face 115 of the first structure 111. As shown most clearly in FIG. 6, the negative space of the first arch 113 is adapted to accommodate the ankle 166 such that the superior surfaces of the midfoot 164 can be cleansed using the cleansing surface 127.

The alignment track 116 is a slot that is formed in the interior surface of the first inferior face 114. The alignment track 116 is sized and positioned to receive and guide the cabinet 102 as it is inserted into the shell 101. The arrangement described here is a type of tongue and groove joint.

The cabinet 102 is a second hollow structure. The interior surfaces of the cabinet 102 form a cleansing surface 127 that is used to cleanse the foot 162. The cabinet 102 is contained within the shell 101. The cabinet 102 is inserted in a removable manner into the shell 101. The removable nature of the cabinet 102 allows the cabinet 102 to be replaced for the purposes of: 1) maintenance; and, 2) changing the composition of the cleansing surface 127. The inner dimensions of the shell 101 are greater than the outer dimensions of the cabinet 102 such that the cabinet 102 can be inserted into the shell 101.

The cabinet 102 comprises a second structure 121. The second structure 121 comprises a second opening 122, a second arch 123, a second inferior face 124, a second superior face 125, and a lip 126. The second inferior face 124 is further defined with an interior surface and an exterior surface. The second superior face 125 is further defined with an interior surface and an exterior surface.

The second structure 121 is a second hollow rectangular block structure. The cleansing surface 127 is located on the interior surfaces of the second structure 121.

The second opening 122 of the second structure 121 is an open face into which the foot 162 of the bather 161 is inserted for cleansing. The second inferior face 124 is the face of the second structure 121 that is proximal to the first inferior face 114 during normal use of the invention 100. The second inferior face 124 is formed as a foraminous surface that allows water to flow through the invention 100. The second superior face 125 is the face of the second structure 121 that is proximal to the first superior face 115 during normal use of the invention 100. The second superior face 125 is formed as a foraminous surface that allows water to flow through the invention 100.

The second arch 123 is a curved boundary that forms a negative space in the second superior face 125 of the second structure 121. As shown most clearly in FIG. 6, the negative space of the second arch 123 is adapted to accommodate the ankle 166 such that the superior surfaces of the midfoot 164 of the bather 161 can be cleansed using the cleansing surface 127. As shown most clearly in FIG. 1, during normal use of the invention 100 the first arch 113 and the second arch 123 are aligned when the cabinet 102 is inserted in the shell 101.

The lip 126 is a ramp that is formed between the interior surface of the second inferior face 124 and the supporting surface 151 when the invention 100 is used normally. The lip 126 is attached at the second opening 122 of the second structure 121.

The cleansing surface 127 is an abrasive surface that is attached to the interior surfaces of the second structure 121. The foot 162 of the bather 161 is rubbed against the cleansing surface 127 during the cleansing process. In the first potential embodiment of the disclosure, the cleansing surface 127 comprises a brush 141. The brush 141 is further defined with a plurality of bristles 143. In the second potential embodiment of the disclosure, the cleansing surface 127 comprises a pumice 142 surface. The brush 141 is a grooming device that forms the cleansing surface 127 against which the foot 162 is rubbed. The plurality of bristles 143 forms the cleansing surface 127 of the brush 141. Each of the plurality of bristles 143 projects away from the interior surface of the cabinet 102 in a direction away from the exterior surface of the cabinet 102. The pumice 142 is an abrasive surface against which the foot 162 is rubbed.

The interior surface of the second inferior face 124 further comprises a heel depression 128. The heel depression 128 is a shallow cavity formed within the interior surface of the second inferior face 124. The heel depression 128 is an orthopedic accommodation into which the hind foot 165 is placed during normal use of the invention 100. Placing the hind foot 165 in the heel depression 128 slightly raises the forefoot 163 and the midfoot 164, which increases the effective cleansing contact of the cleansing surface 127 with the superior surfaces of the foot 162 of the bather 161.

The exterior surface of the second inferior face 124 further comprises an alignment ridge 129. The alignment ridge 129 is a rectangular block structure that projects away from the exterior surface of the second inferior face 124. The alignment ridge 129 is sized and positioned to be inserted into the alignment track 116 of the shell 101 when the cabinet 102 is inserted into the shell 101.

The second superior face 125 further comprises a soap dispenser 130. The soap dispenser 130 is a mechanical device within which a soap 134 is stored and dispensed for the purpose of cleansing the foot 162 of the bather 161. The soap dispenser 130 comprises a valve 131, a reservoir 132, and a pump 133.

The valve 131 is a check valve that releases the soap 134 from the reservoir 132 into the interior space of the cabinet 102 through the interior surface of the second superior face 125. In the first potential embodiment of the disclosure, the valve 131 is a Tesla valve.

The reservoir 132 is a cavity that is formed within the second superior face 125 of the purpose of the storing the soap 134. As shown most clearly in FIG. 5, the reservoir 132 is accessed through an aperture formed in the exterior surface of the second superior face 125.

The pump 133 is a mechanical device that is used to create a pressure build up within the reservoir 132 that forces the soap 134 through the valve 131. The use of a pump 133 for this purpose is well known and documented in the mechanical arts. The pump 133 is a pedal operated pump 133. Specifically, the pump 133 is installed within the aperture formed in the exterior surface of the second superior face 125 such that when the foot 162 presses against the interior surface of the second superior face 125, the pedal of the pump 133 pressurizes the reservoir 132 thereby forcing soap 134 through the valve 131 and on to the foot 162 of the bather 161.

The pump 133 is installed into the aperture of the reservoir 132 using a threaded connection 135. The soap 134 comprises a readily and commercially available liquid soap. An example of a suitable soap 134 is commonly marketed as a body wash.

The following definitions were used in this disclosure:

Align: As used in this disclosure, align refers to an arrangement of objects that are: 1) arranged in a straight line; or, 2) arranged to give a directional sense of a plurality of parallel lines.

Anterior: As used in this disclosure, anterior is a term that is used to refer to the front side or direction of an object. When comparing two objects, the anterior object is the object that is closer to front of the object.

Arch: As used in this disclosure, an arch refers to a curved edge or surface that bounds a definable negative space.

Ball Valve: As used in this disclosure, a ball valve is a type of commercially available check valve.

Bristle: As used in this disclosure, a bristle is a short coarse stiff hair or hair like object.

Brush: As used in this disclosure, a brush is a device comprising a plurality of bristles set into a handle or a base that is used for grooming, sweeping, smoothing, scrubbing, or painting.

Cavity: As used in this disclosure, a cavity is an empty space or negative space that is formed within an object.

Check Valve: As used in this disclosure, a check valve is a valve that permits the flow of fluid or gas in a single direction. Examples of a check valve include, but are not limited to, a ball valve and a tesla valve.

Exterior: As used in this disclosure, the exterior is use as a relational term that implies that an object is not contained within the boundary of a structure or a space.

Foot: As used in this disclosure, the foot refers to the portion of the leg that is below the ankle. Within this disclosure, the foot is further defined with a forefoot, a midfoot and a hind foot. The forefoot is the region of the foot is the anterior portion of the foot within which the phalanges and the metatarsals bones are located. The midfoot is the region of the foot within, which the navicular, cuboid, and cuneiform bones are located. The hind foot is the region of the foot that is posterior to the midfoot.

Foraminous: As used in this disclosure, foraminous is an adjective that describes a surface, plate, or platform that is perforated with a plurality of holes.

Force Of Gravity: As used in this disclosure, the force of gravity refers to a vector that indicates the direction of the pull of gravity on an object at or near the surface of the earth.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is use as a relational term that implies that an object is contained within the boundary of a structure or a space.

Inferior: As used in this disclosure, the term inferior refers to a directional reference that is parallel to and in the same direction as the force of gravity.

Negative Space: As used in this disclosure, negative space is a method of defining an object through the use of open or empty space as the definition of the object itself, or, through the use of open or empty space to describe the boundaries of an object.

Non-Skid Material: As used in this disclosure, a non-skid material is a commercially available product that can be applied to an object such that the object is inhibited from sliding along the surface upon which the object is resting. Non-skid materials are often, but not always, adhesive or abrasive materials.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pedal: As used in this disclosure, a pedal is a foot operated lever that is used by the foot to power mechanical devices.

Posterior: As used in this disclosure, posterior is a term that is used to refer to the side of an object that is distal or in the opposite direction of the anterior side. When comparing two items, the posterior item is the item that is distal from the front of the object.

Pumice: As used in this disclosure, the term pumice refers to an abrasive first surface that is used to prepare or clean a second surface. This contrasts with a more traditional meaning wherein pumice refers to a rock formed from cooling lava that is commonly used for the above described purpose.

Pump: As used in this disclosure, a pump is a mechanical device that uses suction or pressure to raise or move fluids, compress fluids, or force a fluid into an inflatable object.

Ramp: As used in this disclosure, a ramp is an inclined surface that joins two parallel surfaces that are: 1) of different elevations; or 2) not aligned on the same plane.

Rectangular Block: As used in this disclosure, a rectangular block refers to a three dimensional structure comprising six rectangular surfaces formed at right angles. Within this disclosure, a rectangular block may further comprises rounded edges and corners.

Ridge: As used in this disclosure, a ridge is an elevated or raised portion of a structure or a surface.

Shell: As used in this disclosure, a shell is a structure that forms an outer covering intended to contain an object. Shells are often, but not necessarily, rigid structures that are intended to protect the object contained within it.

Soap: As used in this disclosure, a soap is a cleansing chemical that is used in cleaning an object. A soap is generally formed from a mixture of one or more salts and one or more fatty acids.

Slot: As used in this disclosure, a slot is a long narrow groove or aperture that is formed in an object.

Superior: As used in this disclosure, the term superior refers to a directional reference that is parallel to and in the opposite direction of the force of gravity.

Supporting Surface: As used in this disclosure, a supporting surface is a horizontal surface upon which an object is placed. Within this disclosure, it is assumed that the object is placed on the supporting surface in an orientation that is appropriate for the normal or anticipated use of the object.

Tesla Valve: As used in this disclosure, a Tesla valve is a type of check valve that requires the use of no moving parts.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

Tongue and Groove Joint: As used in this disclosure, a tongue and groove joint is a joint that is used to fasten a first plate or board to second plate or board. The groove portion of the tongue and groove joint is a groove that is formed in an edge of the first plate or board. The tongue portion of the tongue and groove joint is a ridge that is formed on the edge of the second plate or board. The tongue portion of the tongue and groove joint is sized and shaped such that the tongue portion of the tongue and groove joint can be inserted into the groove portion of the tongue and groove joint thus attaching the first plate or board to the second plate or board.

Track: As used in this disclosure, a track is a slot that is formed in a surface of a first object that is formed to receive a ridge formed in a second object for the purpose of fastening the second object to the first object.

Valve: As used in this disclosure, a valve is a device that is use to control the flow of a fluid (gas or liquid) through a pipe.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A body washing implement comprising:

a shell and a cabinet;

wherein the cabinet inserts into the shell in a removable manner;

wherein a pedal operated soap dispenser is installed in the body washing implement such that a soap may be dispensed;

wherein the body washing implement is adapted for use with the foot of a bather;

wherein the bather is further defined with a foot;

wherein the foot is further defined with an ankle, a forefoot, a midfoot, and a hind foot;

wherein the body washing implement is configured for use with a shower;

wherein the body washing implement cleanses the foot of the bather while simultaneously allowing the bather to stand erect;

wherein to cleanse the foot, the forefoot is inserted into an open end of the body washing implement where the foot is rubbed against a cleansing surface within the cabinet;

wherein the shell comprises a first structure and a non-skid footing;

wherein the non-skid footing is attached to the exterior of the first structure;

wherein the first structure is a first hollow rectangular block structure that is used to house the cabinet;

wherein the first structure comprises a first opening, a first arch, a first inferior face, a first superior face, and an alignment track;

wherein the first opening, the first arch, the first inferior face, the first superior face and the alignment track are formed within the first hollow rectangular block structure;

wherein the first inferior face is further defined with an interior surface and an exterior surface;

wherein the first superior face is further defined with an interior surface and an exterior surface;

wherein the first inferior face is the face of the first structure that is placed upon a supporting surface;

wherein the first superior face is the face of the first structure that is distal from the first inferior face;

wherein the non-skid footing is a non-skid material that attaches to the exterior surface of the first inferior face.

2. The body washing implement according to claim 1 wherein the first opening of the first structure is an open face into which the cabinet and the foot are inserted;

wherein the alignment track is a slot that is formed in the interior surface of the first inferior face;

wherein the alignment track is sized and positioned to receive and guide the cabinet as it is inserted into the shell.

3. The body washing implement according to claim 2 wherein the first inferior face is formed as a foraminous surface;

wherein the first superior face is formed as a foraminous surface.

4. The body washing implement according to claim 3 wherein the first arch is a curved boundary that forms a first negative space in the first superior face of the first structure;

wherein the first negative space of the first arch is adapted to accommodate the ankle such that the superior surfaces of the midfoot can be cleansed.

5. The body washing implement according to claim 4 wherein the cabinet comprises a second structure;

wherein the second structure is a second hollow rectangular block structure;

wherein the second structure comprises a second opening, a second arch, a second inferior face, a second superior face, and a lip;

wherein the second opening, the second arch, the second inferior face, the second superior face, and the lip are formed in the second hollow rectangular block structure;

wherein the second inferior face is further defined with an interior surface and an exterior surface;

wherein the second superior face is further defined with an interior surface and an exterior surface;

wherein the second inferior face is the face of the second structure that is proximal to the first inferior face during normal use of the body washing implement;

wherein the second superior face is the face of the second structure that is proximal to the first superior face during normal use of the body washing implement;

wherein the interior surfaces of the cabinet form a cleansing surface that is used to cleanse the foot;

wherein the cleansing surface is located on the interior surfaces of the second structure.

6. The body washing implement according to claim 5 wherein the inner dimensions of the shell are greater than the outer dimensions of the cabinet such that the cabinet can be inserted into the shell.

7. The body washing implement according to claim 6 wherein the second opening of the second structure is an open face into which the foot of the bather is inserted;

wherein the lip is a ramp formed between the interior surface of the second inferior face and the supporting surface;

wherein the lip is attached at the second opening of the second structure.

8. The body washing implement according to claim 7 wherein the second inferior face is formed as a foraminous surface;

wherein the second superior face is formed as a foraminous surface.

9. The body washing implement according to claim 8 wherein the second arch is a curved boundary that forms a second negative space in the second superior face of the second structure;

wherein the second negative space of the second arch is adapted to accommodate the ankle such that the superior surfaces of the midfoot of the bather can be cleansed.

10. The body washing implement according to claim 9 wherein the first arch and the second arch are aligned when the cabinet is inserted in the shell.

11. The body washing implement according to claim 10 wherein the interior surface of the second inferior face further comprises a heel depression;

wherein the heel depression is a shallow cavity;

wherein placing the hind foot in the heel depression slightly raises the forefoot and the midfoot;

wherein the exterior surface of the second inferior face further comprises an alignment ridge;

wherein the alignment ridge is a rectangular block structure that projects away from the exterior surface of the second inferior face;

wherein the alignment ridge is sized and positioned to be inserted into the alignment track of the shell when the cabinet is inserted into the shell.

12. The body washing implement according to claim 11 wherein the second superior face further comprises a soap dispenser;

wherein the soap dispenser comprises a valve, a reservoir, and a pump;

wherein the valve forms a fluidic connection with the reservoir;

wherein the pump forms a fluidic connection with the reservoir;

wherein the reservoir is a cavity that is formed within the second superior face;

wherein the reservoir is accessed through an aperture formed in the exterior surface of the second superior face.

13. The body washing implement according to claim 12 wherein the valve is a check valve;

wherein the valve releases the soap from the reservoir into the interior space of the cabinet through the interior surface of the second superior face.

14. The body washing implement according to claim 13 wherein the pump is a mechanical device;

wherein the pump creates a pressure build up within the reservoir that forces the soap through the valve;

wherein the pump is installed within the aperture formed in the exterior surface of the second superior face such that when the foot presses against the interior surface of the second superior face, the pedal of the pump pressurizes the reservoir thereby forcing soap through the valve and on to the foot of the bather;

wherein the pump is installed into the aperture of the reservoir using a threaded connection.

15. The body washing implement according to claim 14 wherein the cleansing surface comprises a brush;

wherein the brush is further defined with a plurality of bristles;

wherein the plurality of bristles forms the cleansing surface of the brush;

wherein each of the plurality of bristles projects away from the interior surface of the cabinet in a direction away from the exterior surface of the cabinet.

16. The body washing implement according to claim 15 wherein the valve is a Tesla valve.

17. The body washing implement according to claim 14 wherein the cleansing surface comprises a pumice surface;

wherein the pumice is an abrasive surface.

18. The body washing implement according to claim 17 wherein the valve is a Tesla valve.

* * * * *